United States Patent [19]

Baldenko et al.

[11] Patent Number: 4,470,464

[45] Date of Patent: Sep. 11, 1984

[54] VALVE MEANS

[76] Inventors: Dmitry F. Baldenko, Sevastopolsky prospekt, 83, korpus 1, kv.88, Moscow; Nikolai P. Bezlepkin, ulitsa Koltso Komsomolskaya, 13"A", Oktyabrsky, Bashkirskaya ASSR; Valery I. Semenets, ulitsa Volgina, 83, korpus 1, kv.64, Moscow, all of U.S.S.R.

[21] Appl. No.: 348,060

[22] PCT Filed: Jul. 9, 1981

[86] PCT No.: PCT/SU81/00061

§ 371 Date: Feb. 11, 1982

§ 102(e) Date: Feb. 11, 1982

[87] PCT Pub. No.: WO82/00315

PCT Pub. Date: Feb. 4, 1982

[30] Foreign Application Priority Data

Jul. 17, 1980 [SU] U.S.S.R. ..... 2964425

[51] Int. Cl.[3] ..... E21B 34/08

[52] U.S. Cl. ..... 166/325; 137/117

[58] Field of Search ..... 166/325, 104; 175/107, 175/243, 317; 137/117; 417/299

[56] References Cited

U.S. PATENT DOCUMENTS

| | | | |
|---|---|---|---|
| 2,919,709 | 1/1960 | Schwegman | 166/325 X |
| 3,385,370 | 5/1968 | Knox et al. | 166/325 X |
| 3,661,218 | 5/1972 | Brown | 175/107 |
| 4,300,636 | 11/1981 | Lawrence | 175/317 X |

*Primary Examiner*—Ernest R. Purser
*Assistant Examiner*—Thuy M. Bui
*Attorney, Agent, or Firm*—Murray Schaffer

[57] ABSTRACT

A valve means to be installed in a string of drill pipe above a bottom hole positive displacement motor comprises a hollow housing (1) having an inlet and an outlet for the passage of a drilling fluid therethrough, the wall of the housing having through holes (4) to communicate the interior of the housing with the annular space of the well bore. Secured in the housing (1) substantially above the through holes is a transverse plate or partition (5) provided with a plurality of calibrated openings (6) intended to produce a pressure drop. The housing (1) further accommodates a chamber (7) communicating with the through holes (4) and provided with an open face in the upper portion thereof, the chamber (7) being arranged such that through passages (10) are formed between the chamber (7) and the housing (1). The housing further comprises a sealing couple (12) intended to prevent the through holes (4) from communicating with the interior of the housing (1) in the course of drilling operation. A valve seat (13) of the couple is adapted to fit the circumference of the open face in the upper portion of the chamber (7), whereas a spring-loaded valve element (14) of the couple is capable of being moved axially under the action of the pressure drop, the valve element having a tail-piece (15) the end of which is adapted at least to level with the upper surface of the partition (5).

3 Claims, 5 Drawing Figures

VALVE MEANS

FIELD OF THE INVENTION

The present invention relates to the art of earth drilling and, more particularly, to valve means.

PRIOR ART

There is known a valve means that can be disposed inside a drilling string above a bottom hole positive displacement motor and serving for filling up and draining off the drill pipes during the round trips, as well as for separating the interior of the drill string from the annular space of the well bore.

The valve means comprises a hollow casing or housing having coaxially arranged inlet and outlet for the passage of a drilling fluid therethrough and through bores or holes provided in the wall of the housing to communicate the interior thereof with the annular space of the well bore. The inlet of the housing is connected to the interior of the drilling string, while the outlet thereof is connected to the interior of the bottom hole motor. A sealing couple is provided to prevent the interior of the housing from communicating with the annular space of the well bore in the course of drilling, the couple having a valve seat secured to the housing below the through holes and a spring-loaded valve element in the form of a plunger. Arranged inside the plunger to extend axially therethrough is a calibrated hole or bore serving to produce a pressure drop under the action of which the plunger is caused to move axially until it fits the valve seat to thereby close the through holes of the housing during the drilling operation; otherwise stated, to prevent the annular space of the well bore from communicating with the interior of the housing; the calibrated bore being actually a means for letting the drilling fluid out of the housing. The plunger is further provided with rubber sealing rings arranged on the outer surface thereof (cf. e.g., U.S. Pat. No. 3,661,218, published 1972, Cl. 175-107).

One disadvantageous feature of the above valve means construction resides in that the use of a drilling mud containing considerable amount of mechanical impurities as the drilling fluid is liable to cause malfunctioning of the valve means. Stoppages of the drilling operation, such as during pipe connection and the like, result in that the plunger tends to assume the initial (transport) upmost position thereby communicating the annular space of the well bore with the interior of the drilling string. Excessive sludge or drill cuttings in the critical zone may lead to the sludge tending to penetrate the space between the housing of the valve means and the outer surface of the plunger adjacent to the spring thereof. Repeated actuation of the surface pumps cause the drill cuttings to hamper the free downward movement of the plunger, which results in a partial overflow of the drilling mud into the annular space of the well bore via the open through holes of the housing.

The sealing rings arranged in the upper and lower exterior surface of the plunger may be damaged when the pressure drop causes the plunger to move downwards to assume the working position with some skewness or misalignment, after which subsequent functioning of the valve means may become impossible due to rapid deterioration of the sealing rings and the valve means becoming inoperable.

SUMMARY OF THE INVENTION

The present invention is directed toward the provision of a valve means wherein calibrated holes or orifices and a sealing couple would be of such a construction which, along with relative simplicity thereof, could enable to improve the reliability and extend the service life (durability) of the valve means in the course of operation in a drilling fluid containing mechanical impurities.

This is attained by that in a valve means installed in a drill string above a positive displacement motor comprising a hollow housing having an inlet for a drilling fluid and an outlet for the drilling fluid to pass through a plurality of calibrated openings to produce a pressure drop, the wall of the housing having through holes intended to communicate the interior of the housing with the annular space of the well bore and a sealing couple for closing these holes during drilling disposed inside the housing and having a valve seat and a spring-loaded valve element adapted to move axially under the action of the pressure drop to fit the valve seat, according to the invention, arranged in the interior of the housing to overlie the through holes is a transverse plate or partition having the calibrated openings, the area adjacent to the through holes accommodating a chamber adapted to communicate with the through holes and having an open face in the upper portion thereof, the chamber being arranged in such a manner as to form between the chamber and the housing passages for the drilling fluid to pass therethrough, the valve seat of the sealing couple being adapted to fit the circumference of the open face in the upper part of the chamber, whereas the valve element is provided with a tailpiece, the end of the tail-piece being adapted at least to level with the upper surface of the partition.

Preferably, the partition is fixedly secured in the housing with the calibrated openings arranged around the circumference thereof, a central hole being provided in the partition to receive the tail-piece of the valve element.

This arrangement of the partition allows two support centering surfaces, one being disposed in the chamber, while another is in the central hole of the partition rigidly secured in the housing, which enables to improve the operational reliability of the valve means.

Alternatively, the partition can be movable, the tail-piece of the valve element being rigidly affixed thereto.

This makes the structure less complicated without affecting the reliability and durability of the valve means due to the movable partition performing apart from the main function thereof (viz. producing a pressure drop because of a flow restriction afforded by the calibrated openings) the function of a guide member for the valve element of the sealing couple.

The valve means according to the invention is structurally simple, reliable in operation and durable, which is especially important when used with a drilling fluid containing mechanical impurities.

The provision of the partition having calibrated openings and the tail-piece attached to the valve element of the sealing couple provides conditions for an improved functioning efficiency of the latter, since in this case a provision is made for two support centering surfaces affording accurate coaxiality of movement in the course of operation.

In addition, the number of movable sealing elements is reduced to a minimum; the sealing elements are continuously washed by the drilling fluid thereby extending their service life during operation in an abrasive medium.

BRIEF DESCRIPTION OF THE DRAWINGS

The invention will now be described in greater detail with reference to specific embodiments thereof taken in conjunction with the accompanying drawings, in which.

The drawings illustrate the valve means in a transport position.

BEST MODE OF CARRYING OUT THE INVENTION

Figure 1:
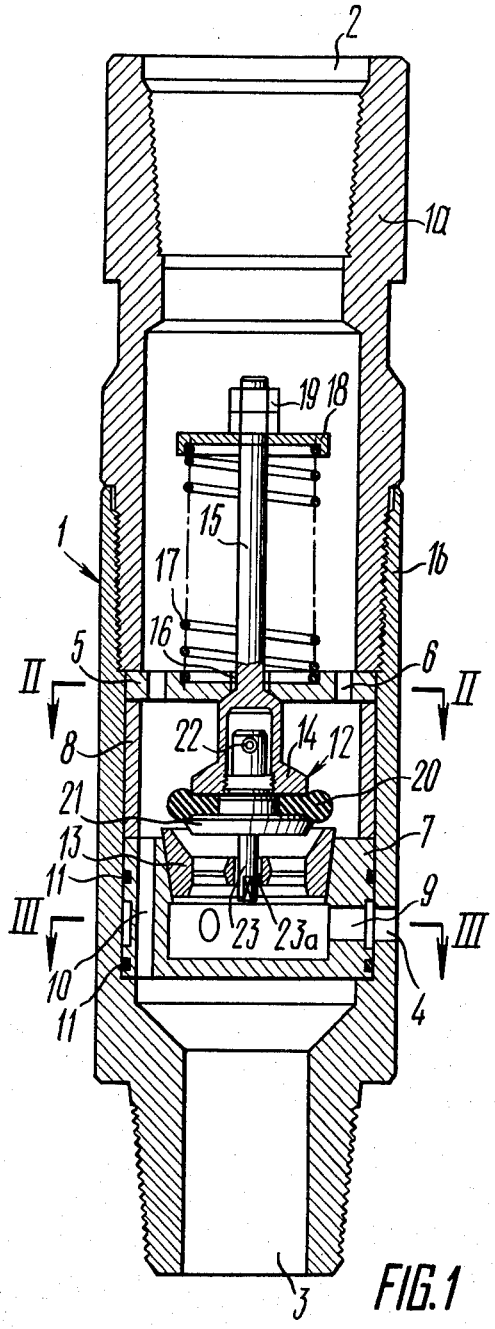
FIG. 1 is a longitudinal sectional view of a valve means according to the invention provided with a rigidly secured partition.
Figure 2:
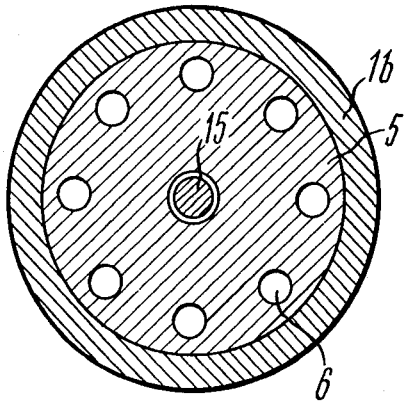
FIG. 2 is a section taken along the line II—II of FIG. 1.

With reference to FIG. 1, the valve comprises a hollow housing 1 having an inlet 2 for admitting a drilling fluid, the inlet being connectable to a drill pipe (not shown), and an outlet 3 connectable to a bottom hole positive displacement motor (not shown). Through holes 4 are provided in the wall of the housing 1 for hydraulically communicating the interior thereof with the annular space of the well bore. Secured in the housing 1 to overlie the holes 4 is a transverse plate or partition 5 provided with calibrated openings or orifices 6 restricting the flow of fluid to produce a pressure drop. The orifices 6 are arranged circumferentially equidistantly on the partition 5 as seen best in FIG. 2.

For ease of installation of the partition 5 the housing 1 (FIG. 1) is made up of two threadedly interconnected sections 1*a* and 1*b*.

Figure 3:
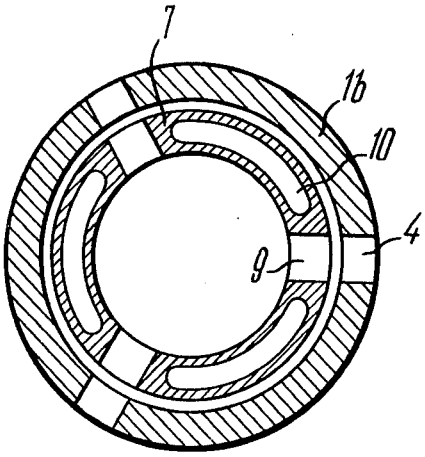
FIG. 3 is a section taken along the line III—III of FIG. 1.

Arranged in the interior of the housing 1 to be adjacent to the through holes 4 is a chamber 7 provided with an open face in the upper portions thereof. A tubular sleeve 8 is secured interjacent relative to the partition 5 and the chamber 7, the latter being provided with through holes 9 in axial alignment with the through holes 4 of the housing 1 to communicate the interior of the chamber 7 with the annular space of the well bore. The housing 1 further has passages 10 (FIGS. 1 and 3) for the passage of the fluid therethrough toward the outlet 3; in the herein described modification the passages 10 extend axially in the wall of the chamber 7. In order to prevent the fluid flowing from the interior of the housing 1 into the annular space of the well bore in the course of operation, the outer wall surface of the chamber 7 has grooves accommodating sealing rings 11 (FIG. 1). In order to separate the interior of the housing 1 from the annular space of the well bore, there is provided a sealing couple 12 comprised of a valve seat 13 affixed by the outer circumference thereof to the open face of the chamber 7 and a valve element 14 having a tail-piece 15. The valve element 14 is adapted for axial displacement caused by a pressure drop to fit the seat 13 in the course of drilling operations.

A central hole 16 is provided in the partition 5 for the reciprocations of the tail-piece 15 therein. The valve element 14 is urged in the upper or transport position by a coil spring 17, one end of which rests on the partition 5, while the opposite end thereof thrusts against a disk member 18 secured to the upper end of the tail-piece 15. A pair of nuts 19 are screwed onto the end of the tail-piece 15 serving to adjust the tension of the spring 17. In order to ensure a more reliable seal, the valve element 14 has a resilient sealing collar 20 arranged on a tray element 21 rigidly connected with the valve element 14, for which purpose there is provided a blind threaded hole. To avoid spontaneous unscrewing a splint pin 22 is mounted in the openings of the tray element 21 and the valve element 14. To assure relative coaxially of the seat 13 and the valve element 14, as well as for a guided displacement or reciprocation of the valve element 14 from a transport position to the operational one and back, a provision is made in the lower portion of the tray element 21 for a guide member 23 received by a central bore 24 of the valve seat 13.

Figure 4:
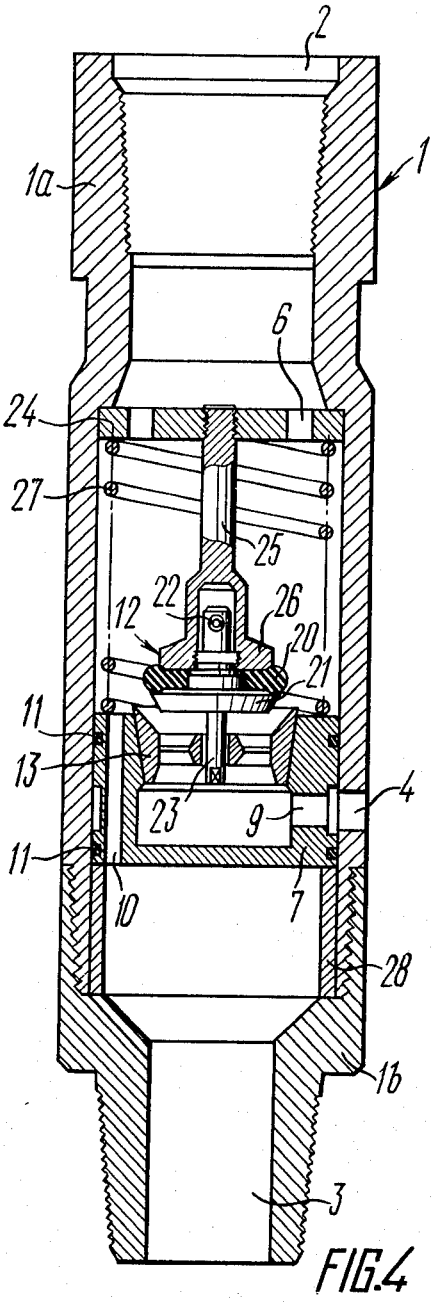
FIG. 4 shows a modification of a valve means according to the invention provided with a movable partition.

With reference to another modification illustrated in FIG. 4, the partition 23*a* is adapted for axial displacement under the action of a pressure drop. A tail-piece 25 of a valve element 26 is rigidly affixed to the partition 24, while a coil spring 27 is interposed between the partition and the chamber 7. In order to adjust the tension of the spring 27, there is provided an adjusting sleeve 28 in the lower portion of the valve means to overlie the chamber 7. Therewith, the position of the chamber 7 is changed in such a manner as not to disturb or hamper the flow of fluid from the annular space of the well bore into the interior of the drill string and vice verse due to altered relative positioning of the holes 4 of the housing 1 and the holes 9 of the chamber 7. Otherwise, the valve arrangement of this modification is basically similar to the one described hereinabove.

Figure 5:
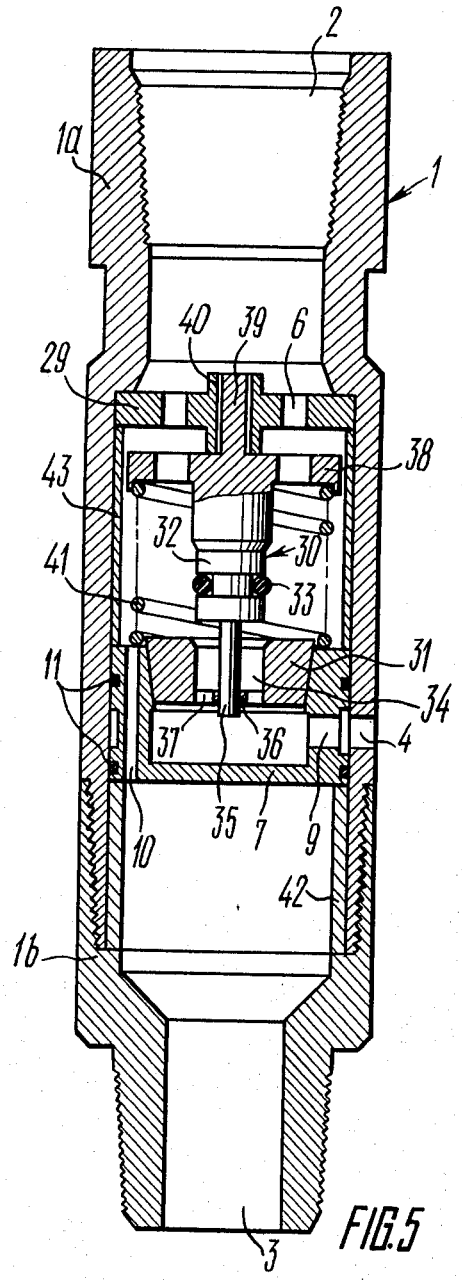
FIG. 5 shows a modification of the valve means provided with a fixed partition and a valve element in the form of a plunger.

Referring now to FIG. 5, there is shown a modified form of the valve means according to the invention, wherein a partition 29 is rigidly secured to the housing, while a sealing couple 30 comprises a valve seat 31 affixed to the chamber 7 and a valve element 32 in the form of a piston or plunger having arranged thereon a sealing O-ring 33 cooperating with a cylindrical bore 34 of the seat 31. The lower portion of the plunger 32 has a guide member 35 engaging with a central opening of another cross-plate or partition 36 arranged in the lower portion of the valve seat 31, this cross-plate or partition having circumferentially disposed openings 37 for the passage of fluid from the annular space of the well bore to the interior of the drill string of pipe and in a reverse direction. The upper portion of the plunger 32 accommodates a thrust disk 38 which is either formed integral with the plunger 32 or rigidly secured thereto. Extending upward of the disk 38 is a tail-piece or shank 39 the radial motions of which are restricted by a central bore 40 of the partition 29. Interposed between the thrust disk 38 and the chamber 7 is a return spring 41. Adjustment of the spring 41 is effected by means of adjusting sleeves 42 and 43.

Operation of the foregoing constructions will be now described with reference to the construction illustrated in FIG. 1.

During lowering of the string of drill pipes provided with a positive displacement motor or without the one, the valve means assumes the transport position whereat the sealing couple 12 is open (the valve element 14 is held by the spring 17 in the upmost position). Therewith, the drilling fluid tends to flow from the annular space of the well bore via the through holes 4 of the housing 1, the holes 9 of the chamber 7, and further through the gap formed between the seat 13 and the valve element 14 to enter the interior of the valve means and the drill spring. The fluid also acts to wash and clean the seat 13 and the valve element 14 of the sealing couple 12.

Following the actuation of the surface mud pumps, the drilling fluid is supplied via the valve means to the bottom hole motor and then to the drilling bit (not shown) or directly to the drilling bit. Therewith, by virtue of a pressure drop produced by the calibrated openings or orifices 6 of the partition 5, the tail-piece 15 of the valve element 14 tends to overcome the compressive force of the spring 17 to move the valve element 14 downwards until it tightly fits the seat 13 thereby reliably closing the sealing couple 12. The fluid rushes through the passages 10 into the working organs of the motor and then toward the drilling bit or directly to the drilling bit. After the surface mud pumps have been stopped and the fluid supply ceased, the coil spring 17 acts to return the valve element 14 to the initial or transport position again communicating the annular space of the well bore with the interior of the drill pipes.

With reference to the embodiment illustrated in FIG. 5, hermetic sealing of the couple 30 is effected by means of the rubber O-ring cooperating with the cylindrical surface of the seat 31. In other respects, the operation of the valve means of this modification is substantially similar to the operation of the valve illustrated in FIG. 1.

In the construction of the valve means shown in FIG. 4 the valve element 26 moves from the transport position to the working position and back together with the movable partition 24.

The absence in the valve means according to the invention of closed volumes promoting the accumulation of cuttings and to thereby hampering its efficient operation affords to materially improve the reliability and extend service life of the valve means. Accordingly, the lack of closed volumes is attained by functionally dividing the valve means into two separate elements: one for the provision of hermetic sealing, another for producing a pressure drop when the surface pumps are actuated to circulate the fluid; this in turn being made possible by the provision of a transverse orificed place or partition and the centering tail-piece extending from the valve element.

The valve means incorporating the features of the present invention is now field tested. Some of the valves being tested have served for over 300 operating hours without parts replacement.

Industrial Applicability

The valve means according to the invention can be employed with advantage in a string of drill pipes to be placed above a bottom hole positive displacement motor used for drilling oil and gas wells with water or drilling mud containing mechanical impurities used as the drilling fluid.

We claim:

1. Valve means for installation in a well bore of a string of drill pipe to overlie a bottom hole positive displacement motor comprising a hollow housing having an inlet and an outlet for the passage of drilling fluid separated by a partition having a plurality of calibrated openings to produce a pressure drop through said housing, said housing having a plurality of through holes in the wall thereof to communicate the interior of the housing with the well bore, a sleeve closed at its bottom end and open at its upper end located within said housing adjacent the area of the through holes, said sleeve defining an interior chamber having radial holes in the wall thereof aligned with said through holes and a plurality of axial passages for the drilling fluid to pass through to said string, a sealing couple for closing the through holes during drilling, said sealing couple comprising a valve seat and a spring loaded valve element adapted to move axially under the action of the pressure drop within said housing to close against the valve seat, said valve seat, being adapted to fit the circumference of the upper open end of said sleeve, said valve element being provided with a tail piece, the end of which is adapted to extend at least to the level of the upper surface of said partition.

2. The valve means according to claim 1, wherein the partition is fixedly secured to the housing, the calibrated openings being arranged around the circumference of the partition, the partition being further provided with a central hole for slidably receiving the tail-piece of the valve element.

3. The valve means according to claim 1, wherein the partition is movable and the tail-piece of the valve element is rigidly secured thereto.

* * * * *